United States Patent [19]

Seal

[11] Patent Number: 4,922,655

[45] Date of Patent: May 8, 1990

[54] VERTICAL CANTILEVERING GATE

[76] Inventor: Morton Seal, 5121 Muddy La., Fort Myers, Fla. 33905

[21] Appl. No.: 142,499

[22] Filed: Jan. 11, 1988

[51] Int. Cl.[5] ..... E06B 11/00

[52] U.S. Cl. ..... 49/131; 160/331; 160/338; 160/32; 49/356; 49/372

[58] Field of Search ..... 49/131, 132, 356, 360, 49/372, 373, 9; 160/32, 33, 331, 338

[56] References Cited

U.S. PATENT DOCUMENTS

| | | | |
|---|---|---|---|
| 144,032 | 6/1951 | Jorgensen | 49/131 |
| 2,614,835 | 10/1952 | Margison et al. | 160/32 |
| 3,722,140 | 3/1973 | Newton | 49/132 |
| 4,576,508 | 3/1986 | Dickinson | 49/131 |

*Primary Examiner*—Kenneth J. Dorner
*Assistant Examiner*—Gerald A. Anderson
*Attorney, Agent, or Firm*—Alfred E. Wilson

[57] ABSTRACT

A vertically movable cantilevering type gate is disclosed. All that is required is an elongated cylinder mounted vertically and a piston rod slidably mounted therein. The piston rod is mounted for vertical movement in the cylinder and suitable laterally spaced vertically movable guides are provided to maintain the gate in alignment with the gate opening. Preferably a channel shaped cap bar is positoned to overlie a trough into which interconnected link members are adapted to fold. The link members support laterally extending mesh type closure members which close the gate opening when the gate is elevated. The gate is controlled by a water pressure operated system. The valves controlling the flow of pressurized water to actuate the gate are controlled electrically. In one desirable construction when no electric power is applied, the valves direct water under pressure to urge the piston rod upwardly in the cylinder to maintain the gate in the obstructing or closed position. When electric power is applied to reverse the position of the valves the piston rod moves downwardly in the cylinder whereupon the gate structure folds into the trough and the channel shaped cap bar member moves to overlie the trough and maintain the gate in the open position.

2 Claims, 1 Drawing Sheet

VERTICAL CANTILEVERING GATE

BACKGROUND OF THE INVENTION

As the land is used more extensively it is subdivided into smaller and smaller tracts, necessitating a greater number of gates. In order to enable the owners and occupants to maintain a degree of privacy it has been customary to provide fences wherein gates are provided at spaced points where necessary to permit access to the properties. It was apparently thought that in order to have a satisfactory gate it was necessary to have a solid construction or at least a metal gate frame having wire mesh therein of relatively heavy gauge to prevent animals of various types from penetrating the gate. These gates were therefor relatively heavy and expensive and were difficult to handle. It was difficult to maintain the gate in operable condition and it was difficult for children to operate the gates as they must in order to have access to their homes.

FIELD OF THE INVENTION

Recently it has been realized that in many instances it is only necessary to provide a barrier which can be economically provided. In the development of my improved gate it was realized that it is only necessary to have a construction that is both economical to make initially and easy to maintain so that it can readily be used by all parties having need therefor, including children, and wherein a lightweight gate is adequate since it is unnecessary under present conditions to have a solid type construction because the forces exerted on the gate are clearly not severe. It was thus realized that the most successful type of gate is one which is realtively lightweight, easy to operate, economical to manufacture and which can be economically maintained over long periods of time, and which present a sufficient barrier to prevent animals, such as cattle and horses from attempting to go through it.

SUMMARY OF THE INVENTION

In the development of my improved gate I have devised a cantilevering type of barrier having a relatively long cylinder mounted vertically and having a piston rod slidably mounted therein to elevate and lower a barrier to obstruct the gate passageway. The barrier can have transversely and vertically extending wire or link meshwork members to position a curtain across the opening when in the obstructing position.

When the gate is in the down or open position the top cap member overlies the trough into which the gate meshwork is folded in the gate open position, and the cap is flush with the surface of the road. Suitable guide members may be spaced out from the actuating cylinder-piston combination to function as a guide to maintain the construction in the proper location relative to the possageway.

DESCRIPTION OF THE PREFERRED EMBODIMENT

Figure 1:
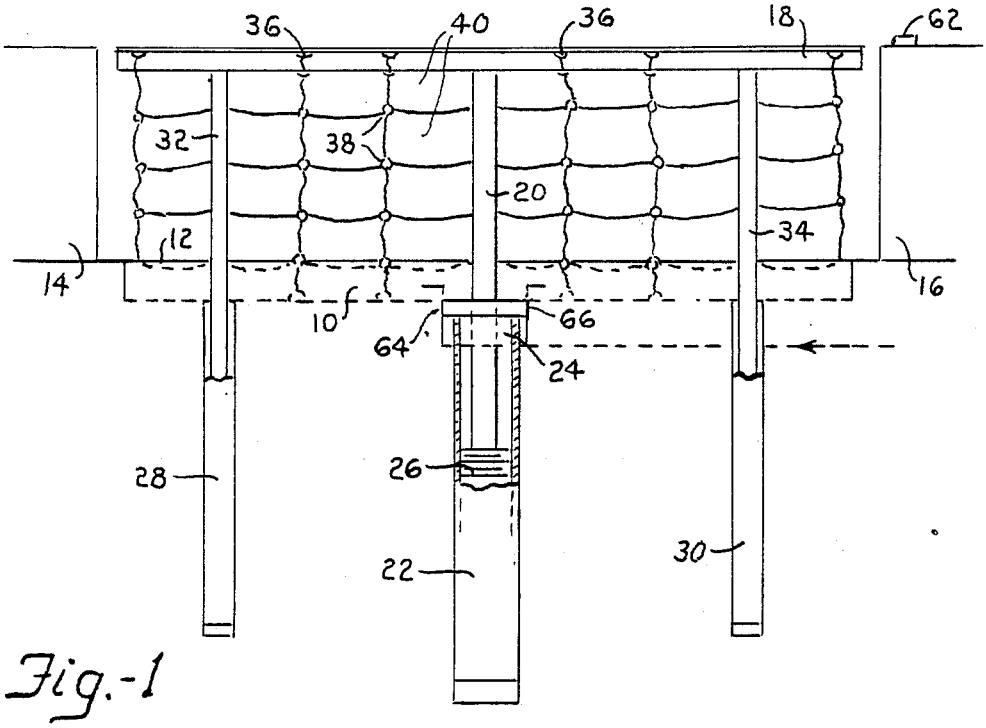
FIG. 1 is a front elevational view of a vertically movable barrier or gate structure adapted to project upwardly to close the accessway and being illustrated in the gate closed position.

Referring now to the drawings a trough 10 extends across a passageway 12 between laterally extending fences 14 and 16 aligned with the trough 10 and the barrier or gate. An inverted channel shaped cap bar 18 is positioned to overlie the trough 10 and to cooperate with the road structure of the passageway to provide a relatively smooth surface over the barrier or gate when the barrier is in the open or down position.

The cap bar 18 is movable from the down or gate open position to an elevated barrier or gate closed position as illustrated in FIG. 1. The cap bar 18 is secured at its approximate mid-section to a vertically movable piston rod 20 slidably mounted in a hydraulic cylinder 22 and guided therein at the top of the cylinder 22 by a cap bushing 24, and at the bottom by a piston 26 secured to the piston rod 20 and slidably mounted for vertical movement in the hydraulic cylinder 22. The gate thus formed is urged upwardly to the gate closed position by fluid pressure exerted in the cylinder 22 between the bottom of the piston 26 and the bottom of the cylinder 22.

The barrier or gate is defined as being the area between the cap bar 18 and the trough 10 when the barrier or gate is in the elevated position. The barrier or gate is aligned with the laterally extending fences 14 and 16, and the barrier is maintained in alignment with the trough 10 in the roadway 12 between the fences 14 and 16 by spaced guides having cylinders 28 and 30 vertically mounted in alignment with the central hydraulic cylinder 22. Laterally spaced guides 32 and 34 secured to the underside of the cap bar 18 are slidably mounted in the guide cylinders 28 and 30 to maintain the gate in proper alignment with the trough 10.

Figure 2:
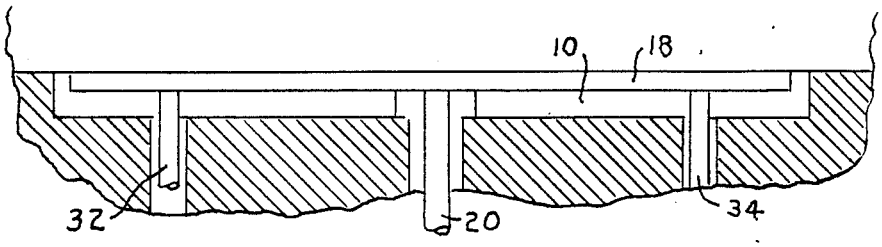
FIG. 2 is a view similar to FIG. 1, but showing the gate construction in the gate open position wherein the vertically movable members are nested in the trough extending across the roadway.
Figure 3:
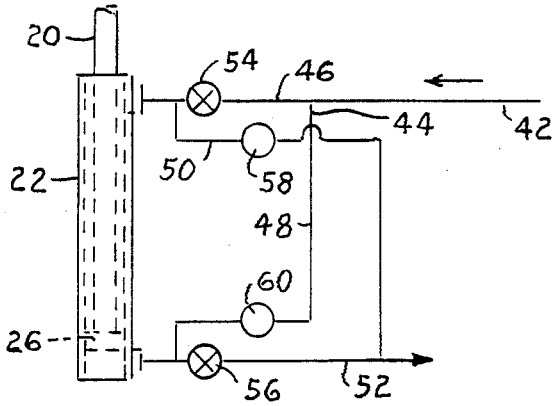
FIG. 3 is a schematic view of the fluid pressure actuated controls.

The central piston rod 20 and the laterally spaced guides 32 and 34 are secured to the underside of the inverted channel shaped cap bar 18 so as not to embody an obstruction in the top of the cap bar 18 over which vehicles would drive when the barrier is in the open or down position as illustrated in FIG. 2.

The underside of the cap bar 18 is provided with a series of hooks or eyelets 36 to receive vertically spaced connectors 38 which are operably connected to horizontal members or links 40 to provide a fold up type barrier or closure for the area beneath the cap bar 18 and the surface of the roadway 12 between the fences 14 and 16 when the barrier is in the closing position.

The horizontal and vertical link members fold into the trough 10 to permit the top of the cap bar 18 to overlie the trough 10 so that the top of the cap bar 18 aligns horizontally with the roadway 12.

While many types of gate actuators are available, and are readily operable to actuate the vertically movable barrier or gate, I have devised a water pressure and electrically actuated barrier or gate actuator operated by water under sufficient pressure, considering the diameter of the cylinder 22 and the piston 26 to exert sufficient pressure in the cylinder to elevate and hold the cap bar 18, and the vertical and horizontal links 40 connected by the links 38 when the barrier or gate is in the obstructing or elevated position.

The water inlet pipe 42 which admits water under pressure has a branch connection at 44 which connect the pipe 42 with two pressure pipe 46 and 48. The pressure pipe 46 connects with the cylinder 22 above the piston 26, and the pressure pipe 48 connects with the cylinder 22 beneath the piston 26. A vent pipe 50 connects with the pressure pipe 46 which connects with the cylinder above the piston 26 and it is a waste or discharge line. Another waste or discharge conduit 52 connects with the pipe 48.

Two electrically actuated normally closed valves 54 and 56 are interposed in the pressure line 46 and in the vent line 52. Two other electrically actuated normally open valves 58 and 60 are interposed in the vent line 50 and in the pressure line 48.

Thus when the device is at rest water under pressure enters through pipe 42 and being shut off in the pipe 46 it flows through the pressure pipe 48, through the normally open valve 60 to the cylinder 22 beneath the piston 26 to elevate the piston in the cylinder to elevate and close the barrier or gate by lifting the cap bar 18 to position the barrier or gate across the roadway 12 in the elevated position between the fences 14 and 16.

When it is desired to lower the barrier or gate to the gate open or unobstructing position the control switch 62 on the end of the fence 16 is actuated to reverse the position of the four valves. This opens the valves 54 and 56 and closes the valves 58 and 60. The pressure pipe 46 controlled by the valve 54 is then shifted to exert pressure in the cylinder 22 above the piston 26 and to open the vent pipe 52 is opened by the reversal of the position of the valve 56 to permit water to flow out of the cylinder beneath the piston 26. The pressurized water above the piston 26 drives the piston rod 20 downwardly in the cylinder 22 to lower the barrier or gate to the unobstructing gate open position. The vented water flows through the trough 10 from the pipes 64 and 66 to wash out any leaves or other debree that may have collected therein.

In instances where it is desired that a relatively few parties can operate the barrier to lower it to the unobstructing position the controls can be operated by conventional garage door opener devices.

In instances where it is desired that the barrier can be actuated by readily operable controls, a switch 62 positioned for example on one of the fences 14 or 16 can be operable to actuate the barrier. This has the advantage that children or visitors can readily actuate the barrier.

I claim:

1. In a vertically movable barrier structure adapted to intersect a passageway, a cap bar a plurality of interconnected horizontal and vertical members connected to the cap bar and, movable between a down passage unobstructing position and an upper passage obstructing position, an actuator comprising a vertically disposed cylinder and piston combination, connecting means between the piston and the cap bar a source of water pressure and a water pressure control means to move the piston in the cylinder, the cap bar member, and the interconnected horizontal and vertical members between the down unobstructing position and the upper passage obstructing position, a trough extending across the passageway to receive the interconnected horizontal and vertical members and the cap bar member aligned with the trough and connecting means between the cap member and one of the horizontal members, the control means wherein the water pressure is employed to raise or lower the barrier structure by feeding pressurized water into one end of the cylinder and water in the other end of the cylinder is vented to the trough due to the differential of water pressure to wash out the trough member when the gate is actuated.

2. The invention defined in claim 1, wherein the two sets of valves are actuated electrically, and the barrier is moved to the obstructing position when the electric current is interrupted.

* * * * *